US009557037B1

(12) United States Patent
Gramelspacher et al.

(10) Patent No.: US 9,557,037 B1
(45) Date of Patent: Jan. 31, 2017

(54) APPARATUS AND METHOD FOR GENERATING AN APPEARANCE OF ANIMATION

(71) Applicant: SPIN MASTER LTD., Toronto (CA)

(72) Inventors: Michael S. Gramelspacher, Carrollton, IL (US); Rory T. Sledge, O'Fallon, IL (US)

(73) Assignee: Spin Master Ltd., Toronto (CA)

( * ) Notice: Subject to any disclaimer, the term of this patent is extended or adjusted under 35 U.S.C. 154(b) by 0 days.

(21) Appl. No.: 15/206,137

(22) Filed: Jul. 8, 2016

(51) Int. Cl.

| | |
|---|---|
| ***A63H 3/02*** | (2006.01) |
| ***F21V 14/02*** | (2006.01) |
| ***F21V 33/00*** | (2006.01) |
| ***F21V 23/00*** | (2015.01) |
| ***F21V 11/00*** | (2015.01) |
| ***A63H 3/00*** | (2006.01) |
| ***A63H 17/28*** | (2006.01) |
| ***A63H 3/28*** | (2006.01) |

(52) U.S. Cl.
CPC ..... *F21V 14/02* (2013.01); *A63H 3/006* (2013.01); *A63H 3/02* (2013.01); *A63H 3/28* (2013.01); *A63H 17/28* (2013.01); *F21V 11/00* (2013.01); *F21V 23/009* (2013.01); *F21V 33/008* (2013.01)

(58) Field of Classification Search
CPC ..... F21V 14/02; F21V 33/008; F21V 23/009; F21V 11/00; A63H 3/02; A63H 3/006; A63H 17/28
See application file for complete search history.

(56) References Cited

U.S. PATENT DOCUMENTS

| | | | | |
|---|---|---|---|---|
| 6,558,225 | B1 * | 5/2003 | Rehkemper | A63H 3/003 40/448 |
| 6,802,757 | B1 * | 10/2004 | Sejnowski | A63H 33/006 446/175 |
| 6,997,772 | B2 * | 2/2006 | Fong | A63H 3/28 446/175 |
| 7,146,760 | B2 * | 12/2006 | Yiu | A47F 3/001 312/114 |
| 7,431,630 | B2 * | 10/2008 | Dubois | A63H 3/28 446/175 |
| 7,871,192 | B2 | 1/2011 | Chien | |
| 2004/0077276 | A1 * | 4/2004 | Fondin | A63H 3/003 446/369 |

* cited by examiner

*Primary Examiner* — Peggy Neils
(74) *Attorney, Agent, or Firm* — Millman IP Inc.

(57) ABSTRACT

In an aspect, an apparatus and method are provided for creating an illusion of animation of a subject shape. The apparatus includes a screen, an intermediate body, a plurality of lights, and a controller in electronic communication with the plurality of lights. The controller is operable to turn the plurality of lights on and off in at least one of: a selected order, a combination, and a simultaneous operation of all of the lights. The intermediate body and the plurality of lights are positioned relative to said screen such that the intermediate body is positioned between the screen and the plurality of lights and such that said plurality of lights are operable to project a plurality of unique outlines of at least portions of the intermediate body onto the screen to generate an illusion of animation of the subject shape.

18 Claims, 5 Drawing Sheets

APPARATUS AND METHOD FOR GENERATING AN APPEARANCE OF ANIMATION

FIELD

The embodiments disclosed herein relate to apparatuses and methods for generating an illusion of animation.

BACKGROUND

Several means have been proposed over the years for creating the illusion of animation in the faces of toy characters in order to provide an enriched user experience for the user. For example, small displays have been used for such a purpose. However, such displays can be expensive and complex to incorporate into such toys and can render the toy less resistant to breakage. It would be advantageous to provide a toy or any other device that at least partially addressed one or more of these problems.

SUMMARY

This document describes a method of generating an illusion of animation of a subject shape. The method may comprise providing a screen, providing an intermediate body and a plurality of lights, positioning the intermediate body and plurality of lights into fixed positions relative to the screen such that the intermediate body is positioned between the screen and the plurality of lights and such that each light in the plurality of lights is operable to project a unique outline of said intermediate body onto said screen, said unique outline depicting the subject shape in a unique state of that subject shape. The method may further include operating the plurality of lights in at least one of: a selected order, a combination, and simultaneous operation of all of said lights, to project a plurality of unique outlines onto the screen and thereby generate the illusion of animation of the subject shape.

In another aspect, the method may include selecting a shape of the intermediate body such that operating the plurality of lights in a selected order projects a succession of unique outlines of the intermediate body onto the screen, and such that at least two unique outlines in said succession of unique outlines depict the subject shape, and each of the at least two unique outlines depicts the subject shape in a unique state of that subject shape. The method may further include operating the plurality of lights sufficiently quickly such that viewing the at least two unique outlines in said succession may create an illusion of animation of that subject shape.

In another aspect, this document describes an apparatus for creating an illusion of animation of a subject shape. The apparatus may comprise a screen, an intermediate body, a plurality of lights; and a controller in electronic communication with said plurality of lights. Said controller may be operable to turn the plurality of lights on and off in at least one of: a selected order, a combination, and a simultaneous operation of all of the lights. The intermediate body and plurality of lights may be fixed relative to the screen such that the intermediate body is positioned between the screen and the plurality of lights, such that when at least one light in the plurality of lights is operated, that light projects a unique outline of at least a portion of the intermediate body onto the screen, and such that said unique outline depicts said subject shape in a unique state of that shape.

In yet another aspect, this document describes an apparatus for creating an illusion of animation of a subject shape via a silhouette of that shape. The apparatus may include a translucent body having a viewing side and a lights-side opposite the viewing side, an intermediate body, a plurality of lights disposed on the lights-side of said translucent body, and a controller in electronic communication with the plurality of lights. The controller may be operable to operate said plurality of lights in at least one of: a sequence, a combination, and a simultaneous operation of all of the lights. The intermediate body and plurality of lights may be positioned relative to the translucent body and the intermediate body may be positioned between the translucent body and the plurality of lights such that when at least one light in the plurality of lights is turned on, a silhouette of the intermediate body is visible through the translucent body from the viewing side of the translucent body.

Other aspects and features will become apparent, to those ordinarily skilled in the art, upon review of the following description of some exemplary embodiments.

BRIEF DESCRIPTION OF THE DRAWINGS

The drawings included herewith are for illustrating various examples of articles, methods, and apparatuses of the present specification. In the drawings.

DETAILED DESCRIPTION OF EXAMPLE EMBODIMENTS

Examples of methods and apparatuses are described below. No example described below limits any subject matter claimed in this patent application. The claims in this patent application may cover methods and apparatuses that differ from those described below. The subject matter claimed in this patent application is not limited to methods and apparatuses having all of the features of any one embodiment of an apparatus or method described below. Patentable subject matter described below that is not claimed in this patent application may be claimed in another patent or other application for the protection of intellectual property in the subject matter.

Figure 1:
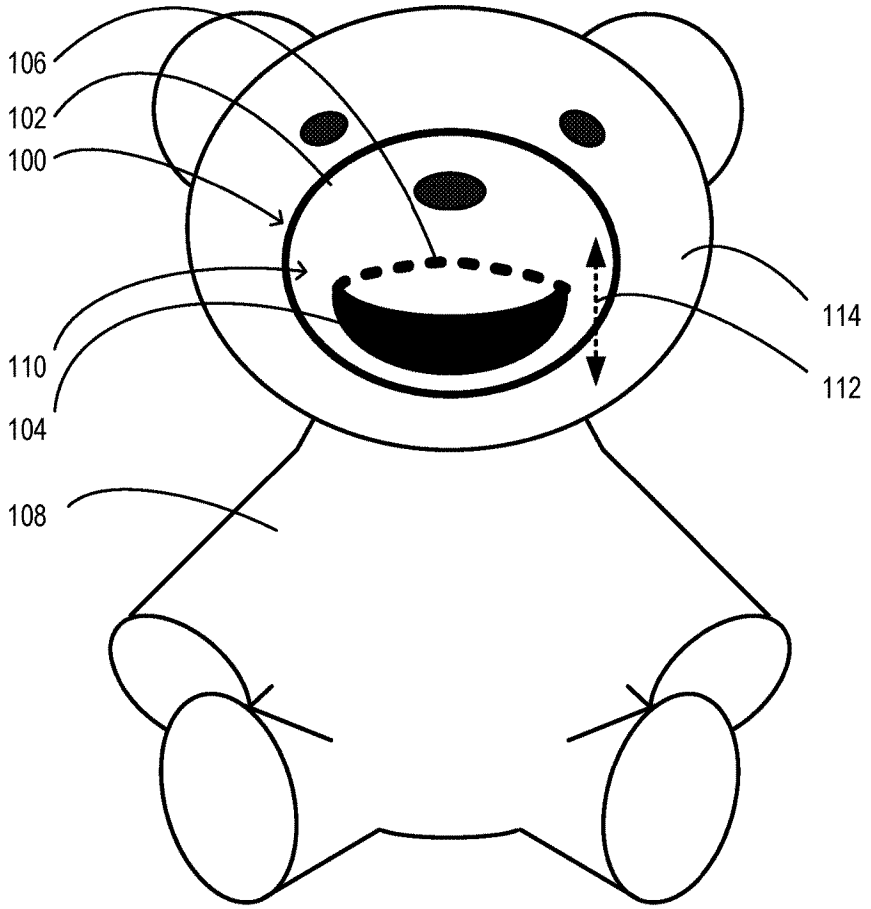
FIG. 1 is a side view of an apparatus for generating an illusion of animation of a subject shape, according to one embodiment, implemented in a toy.
Figure 2:
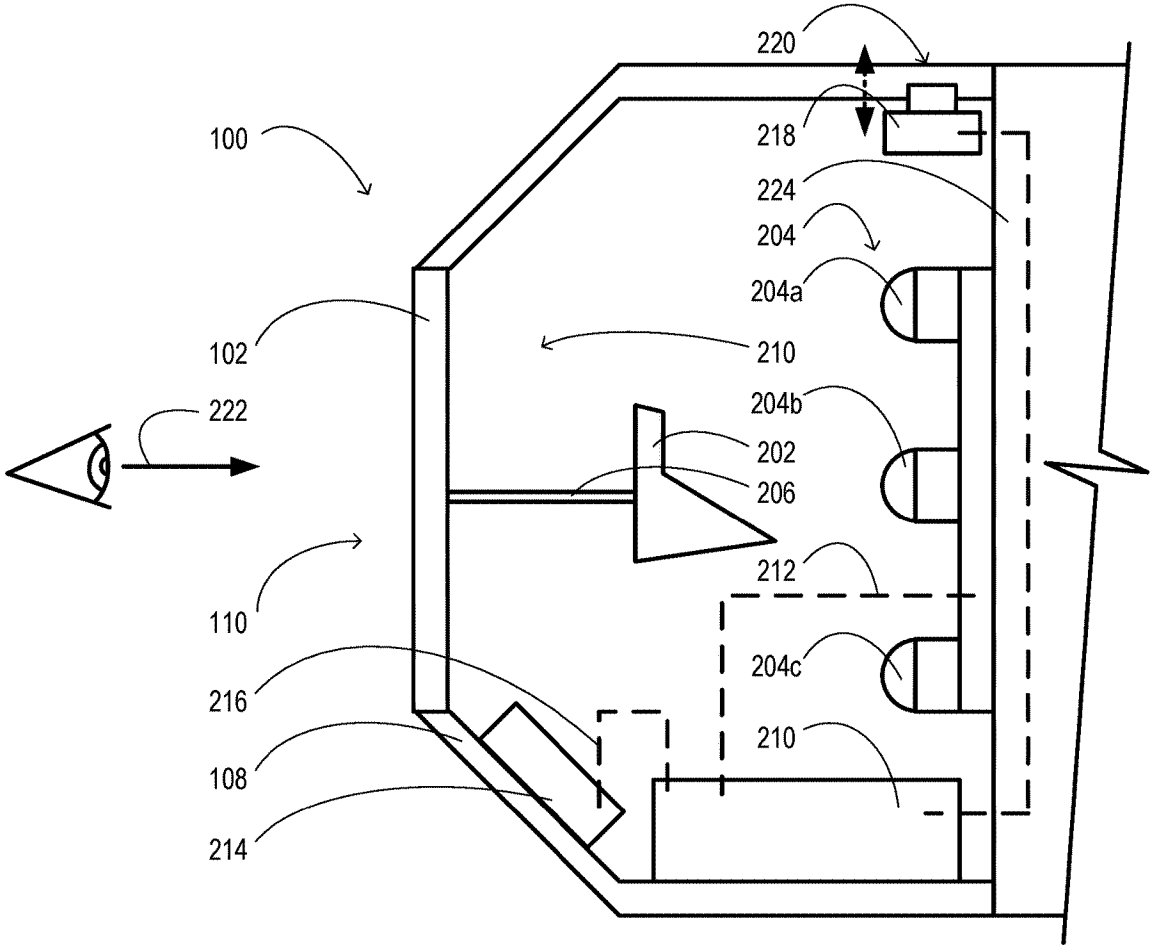
FIG. 2 is a side section view of the apparatus of FIG. 1.

Reference is made to FIGS. 1 and 2, which show an embodiment of an apparatus 100 for generating an illusion of animation of a subject shape 104, 106. In one aspect, the apparatus 100 may be implemented with a toy 108. In this example, the subject shape may include one or more parts of the toy. In a particular example, the toy may be a plush toy 108 and the subject shape may be the mouth 104, 106 of the toy. The illusion of animation may include generating an illusion that the mouth 104, 106 of the toy 108 is moving between, for example, smiling 104 and frowning 106 positions. In another particular example, the apparatus 100 may be implemented with a toy car (not shown) and may be used to generate an illusion of animation of, for example, graphics (not shown) applied to the toy car.

Figure 3:
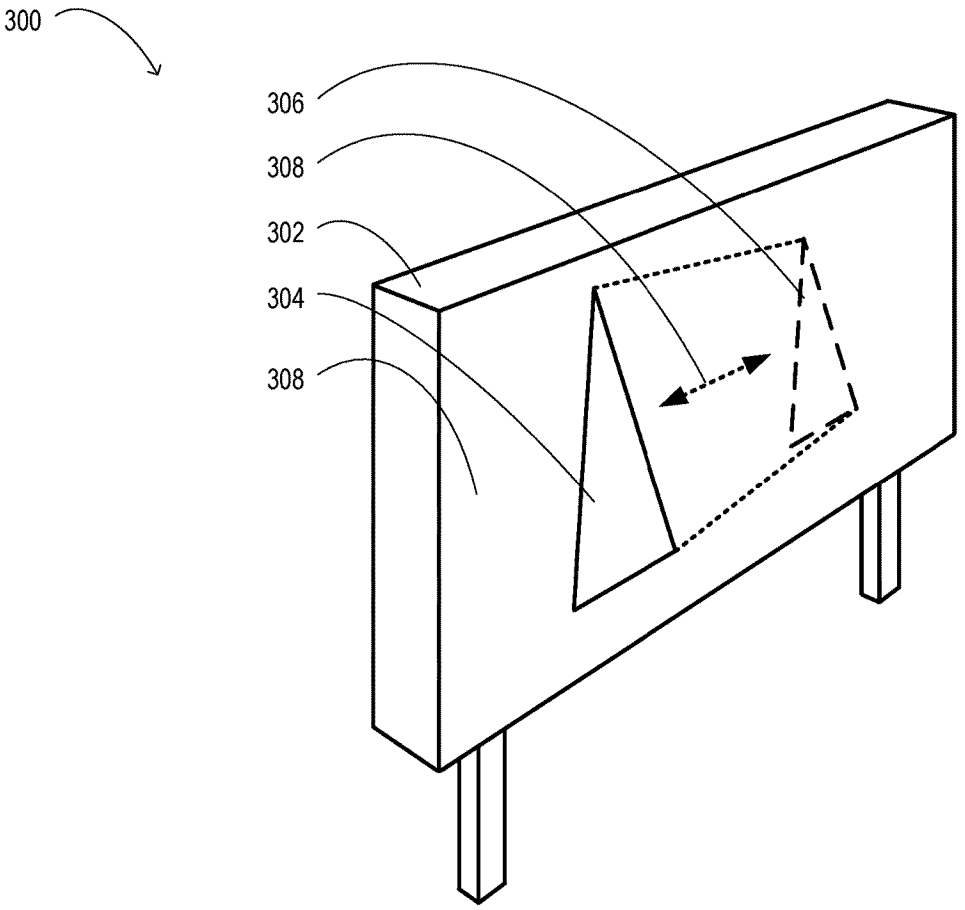
FIG. 3 is a perspective view of an apparatus for generating an illusion of animation of a subject shape, according to another embodiment, implemented in a billboard.

The apparatus 100 may have implementations in a wide range of applications in which animation(s) of shapes may be desired. For example, the apparatus 100 may be configured for advertising. A subject shape may include at least one of a distinctive mark, such as a trademarks, and text. As shown in FIG. 3, the apparatus 300 may be implemented as a billboard 302 and the subject shape may be a trademark 304, 306. The apparatus 300 may generate an illusion of animation 308 of the trademark, and may thereby attract attention of a target audience.

Particular examples of embodiments of the apparatus 100, 300, 400 are described next.

Reference is now made to FIG. 2. As shown, the apparatus 100 for creating an illusion of animation of a subject shape may comprise a screen 102, an intermediate body 202, and a plurality of lights 204. The apparatus 100 may comprise a controller 210 in electronic communication with the plurality of lights 204. Electronic communication may be implemented using any suitable technology, such as at least one of hard wiring 212, and a combination of a wireless transmitter and a receiver (not shown).

The controller 210 may be operable to turn the plurality of lights 204 on and off in at least one of: a selected order, a combination, and a simultaneous operation of all of the lights 204. The selected order may include any suitable sequence of turning on individual lights, combinations of lights, or all of the lights 204*a*, 204*b*, 204*c* in the plurality of lights 204 for periods of time suitable to achieve a particular desired illusion of animation 112 of the subject shape 104, 106.

The intermediate body 202 and the plurality of lights 204 may be fixed relative to the screen 102 (that is, may be in fixed positions relative to the screen 102) such that the intermediate body 202 may be positioned between the screen 102 and the plurality of lights 204, such that when at least one light 204*a*, 204*b*, 204*c* in the plurality of lights 204 is operated, that light 204*a*, 204*b*, 204*c* may project a unique outline 104, 106 of at least a portion of the intermediate body 202 onto the screen 102. The unique outline 104, 106 may depict the subject shape 104, 106 in a unique state of that subject shape. In the example of the plush toy 108, at least two unique outlines 104, 106 may depict the mouth 104, 106 of the toy 108 in the smiling 104 and frowning 106 positions, respectively.

Suitable selected orders of operation of the plurality of lights 204 may be selected depending on the particular subject shape 104, 106 chosen to be projected by the apparatus 100, and the type of illusion of animation 112 desired to be achieved for that subject shape 104, 106. For example, in an embodiment, the selected order of operation of the plurality of lights 204 may be dictated based on speech that is emitted from a speaker that is incorporated into the toy 108. The projected subject shapes 104 and 106 may be selected based on which one best visually represents the shape of the mouth of the character when uttering certain phonemes that are being emitted from the speaker. For example, when uttering the sound 'ee' the subject shape 104 or 106 may be the one that most closely represents the mouth of the character being open in a relatively large smile, whereas when uttering the sound 'ah' the subject shape 104 or 106 may be the one that most closely represents the mouth of the character being open in a relatively large oval shape. Alternatively, the projected subject shapes 104 and 106 may be selected based on which one best visually represents the appropriate mood of the character when uttering certain statements. For example, if the speech being emitted from the speaker describes a sad event, then the projected subject shape 104 or 106 may be a frown, whereas if the speech being emitted from the speaker describes a happy event, then the projected subject shape 104 or 106 may be a smile. In another example, the apparatus 100 may be configured such that the lights 204 show the mouth of the character in a relatively consistent shape, but with varying degrees of openness. In other words, a first light 204 may illuminate to show the mouth in a relatively less-open position, and a second light 204 may illuminate to show the mouth in a relatively more-open position, while additional lights 204 are individually illuminated to show the mouth in a series of intermediate positions between the relatively less-open position and the relatively more-open position. While sound (e.g. speech) is being emitted from a speaker on the apparatus 100, a controller on the apparatus can, in real time, determine an average amplitude of the sound, and can illuminate whichever of the lights 204 suitably represents the position of the mouth that would correlate with that amplitude.

In the embodiment shown in FIG. 2, the apparatus includes three lights 204*a*, 204*b*, 204*c* and is configured to generate an illusion of a mouth moving 112 between smiling and frowning positions, a suitable selected order may include turning the first light 204*a* on for a first period of time, then turning that light 204*a* off and turning on the second light 204*b* for a second period of time, then turning the second light 204*b* off and turning the third light 204*c* on for a third period of time, then turning the third light 204*c* off and repeating the sequence. In another aspect, the intermediate body 202 may be shaped according to the relative positions of each light in the plurality of lights 204, such that when each light is turned on, it projects a desired unique outline 104, 106 for that light.

Periods of time of operation of each light 204*a*, 204*b*, 204*c* in the plurality of lights 204 may be pre-selected to provide a sufficiently rapid succession of unique outlines 104, 106 so as to generate an illusion of animation 112. In some examples, such periods of time may be equal to each other. In other examples, such periods of time may be different, depending on particular animation effects desired to be achieved. It will be appreciated that selected orders of operation of the lights may include turning lights 204 on and off one by one, in pairs, or in any other combinations and orders of operation that may achieve, in combination with the shape and position of the intermediate body 202, a desired illusion of animation 112 of the subject shape.

In the example shown in FIG. 2, a selected order may include turning the plurality of lights 204 on and off in the following order: top 204*a*, middle 204*b*, then bottom 204*c*. Another selected order may include turning lights on and off in the following alternative order: top 204*a*, bottom 204*c*, then middle 204*b*. Other selected orders may include any suitable permutation of operation of the top 204*a*, middle 204*b*, and bottom 204*b* lights. In some embodiments, the apparatus 100 may comprise fewer lights than three lights 204 and may comprise a single light operable to mimic the operation of plurality of lights 204. In other embodiments, the apparatus may have more than three lights 204.

Selected orders of operation of the plurality of lights 204 may be cyclical. The controller of the apparatus 100, 300 may be operable to operate the plurality of lights 204 in more than one selected order. One or more selected orders may be triggered using any one or a combination of triggers suitable for a given embodiment and application of the apparatus 100, 300. Suitable triggers may be implemented using any known technology. In the particular example where the apparatus 100 is applied to a plush toy 108, a suitable trigger may include a push-button 218 disposed under a surface 220 of the plush toy 108. Another suitable trigger may include a sensor (not shown) operable to initiate the operation of the controller 210, in response to the plush toy 108 being, for example, turned upside down and back into an upright position.

In another aspect, the screen 102 of the apparatus 100, 300 may include at least one material selected from a group of translucent and transparent materials. In one example, the at least one material may be selected such that light originating from the plurality of lights 204 and passing through the screen 102 generates a projection of the subject shape 104, 106 on the screen 102.

In a further aspect, the screen 102 may have a viewing side 110 and a lights-side 210. The viewing side 110 may be opposite the lights-side 210. The lights-side 210 may face the plurality of lights 204. The screen 102 may have a translucency selected such that each unique outline 104, 106 of the intermediate body 202 projected onto the screen 102 is visible on the screen 102 to a user of the apparatus viewing 222 the screen 102 from the viewing side 110. In yet another aspect, the translucency of the screen 102 may be selected such that the intermediate body 202 may be substantially invisible to the user viewing 222 the screen 102 from the viewing side 110 of the screen 102.

The intermediate body 202 may be shaped such that at least two unique outlines 104, 106 projected onto the screen 102 by at least two lights in the plurality of lights 204 depict the subject shape 104, 106, and each of the at least two unique outlines 104, 106 depicts the subject shape 104, 106 in a unique state of that subject shape 104, 106. In another aspect, the plurality of lights 204 may be positioned relative to the screen 102 and the intermediate body 202, and the intermediate body 202 may be shaped, such that two or more unique outlines may in combination depict the subject shape in a unique state of that shape. That is, each of at least two unique outlines may depict a portion of the subject shape.

In another aspect, the apparatus 100, 300, 400 may comprise more than one intermediate body 202 to achieve the functionality described in this document.

In yet another aspect, the screen 102 may replace at least one part of an object with which the apparatus 100 may be implemented. In the example of the plush toy 108, the screen 102 may be disposed in place of a part of the head of the plush toy 108 such that the unique outlines depicting the mouth 104, 106 of the toy may place the mouth 104, 106 of the toy in a correct position relative to the rest of the plush toy 108.

The screen 102 may include any shape suitable to provide, in combination with the other components that a given apparatus 100, 300 may comprise, the functionality of the apparatus 100, 300 described in this document. In one example, the screen 102 may have a concave portion. In another example, the screen 102 may have a convex portion. In other examples, the screen 102 may be flat.

In another aspect, the intermediate body 202 may include a plurality of non-coplanar outline surfaces oriented relative to each of the screen 102 and the plurality of lights 204 such that at least a portion of light emitted by each light in the plurality of lights 204 when that light is turned on is obstructed by at least one of the surfaces and is thereby prevented from shining directly onto the screen 102.

Figure 4A:
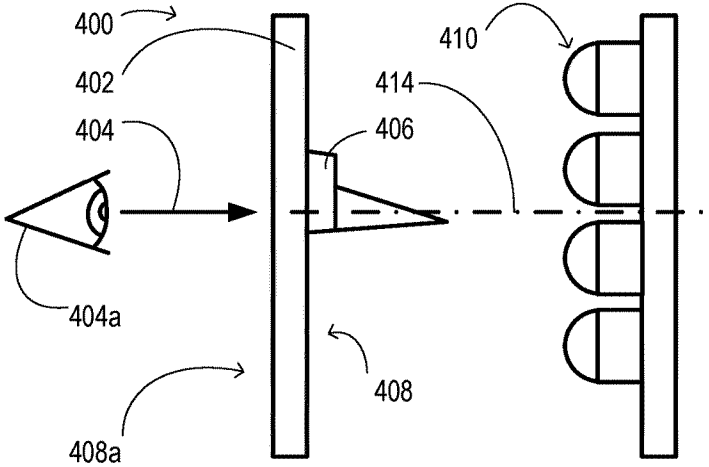
FIG. 4A is a side section schematic view of an apparatus for generating an illusion of animation of a subject shape, according to another embodiment.
Figure 4B:
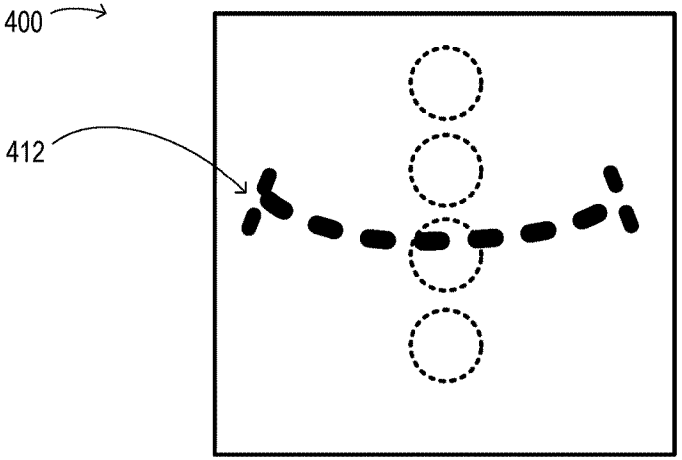
FIG. 4B is a front view of the apparatus of FIG. 4A.
Figure 4C:
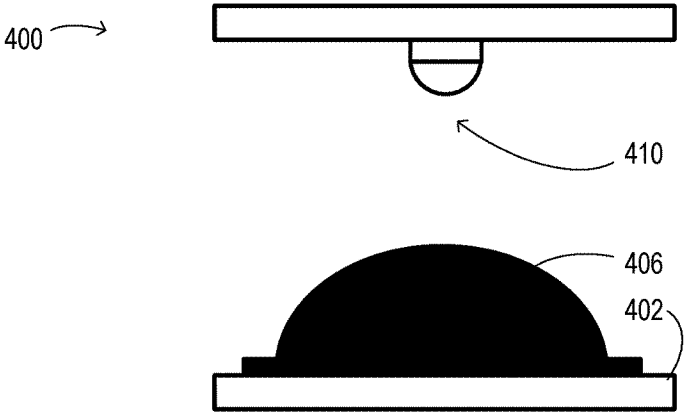
FIG. 4C is a top section schematic view of the apparatus of FIG. 4A.

Reference is now made to FIGS. 4A to 4C, which show various views of another implementation of an apparatus 400 for creating an illusion of animation of a subject shape. The apparatus 400 may comprise a translucent body 402 having a viewing side 408*a* and a lights-side 408 opposite the viewing side 408*a*. The apparatus 400 may further comprise an intermediate body 406, a plurality of lights 410 disposed on the lights-side 408 of the translucent body 402, and a controller (not shown) in electronic communication with the plurality of lights 410. The controller may be similar to the controller described with respect to other embodiments and may, likewise, be operable to turn the plurality of lights 410 on and off in at least one of: a sequence, a combination, and a simultaneous operation of all of the lights.

The intermediate body 406 and plurality of lights 410 may be in fixed positions relative to the translucent body 402 and the intermediate body 406 may be positioned between the translucent body 402 and the plurality of lights 410 such that when at least one light in the plurality of lights 410 is turned on, a silhouette 412 of the intermediate body 406 may be visible through the translucent body 402 to a viewer 404*a* of the apparatus viewing 404 the intermediate body 406 from the viewing side 408*a* of the translucent body 402.

Figure 5B:
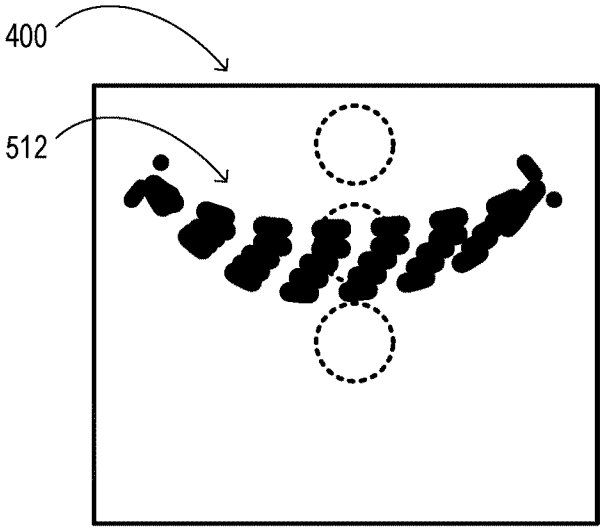
FIG. 5B is a front view of the apparatus of FIG. 5A.
Figure 5A:
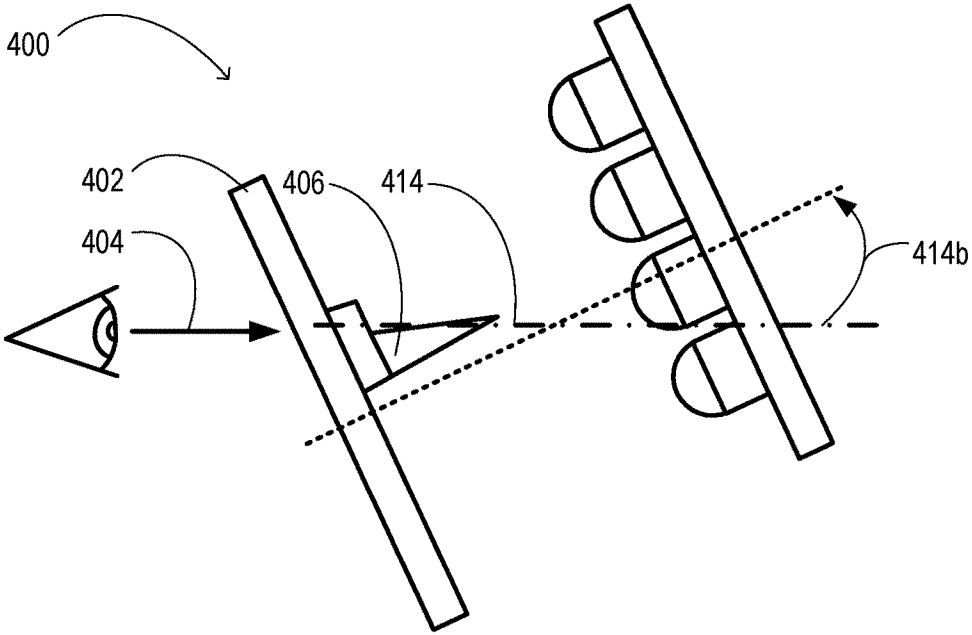
FIG. 5A is a side section schematic view of the apparatus of FIGS. 4A-C, rotated to a degree of rotation.

Reference is now also made to FIGS. 5A and 5B. The translucent body 402 may have a first (not shown, zero angle relative to a plane 414) and second 414*b* degrees of rotation about a plane 414 and relative to a point of view 404. The intermediate body 406 may be shaped such that when at least one corresponding light in the plurality of lights 410 is turned on and when the silhouette 412 is viewed from the point of view 404, the silhouette 412 may depict the subject shape in a first state 412 of that shape when the translucent body 402 is positioned in the first degree of rotation.

In this configuration, the silhouette may depict the subject shape in a second state 512 of that shape when the translucent body 402 is positioned in the second degree of rotation 414*b* and viewed from the same point of view 404. Further, when viewing the intermediate body 406 from the same point of view 404, the subject shape may change from the first state 412 into the second state 512 as the translucent body 402 is rotated from the first degree of rotation toward the second degree of rotation 414*b*. The plurality of lights 410 and the intermediate object 406 may be positioned relative to the translucent body 402, and the intermediate object 406 may be shaped, so as to cooperatively provide a similar illusion of animation of the silhouette when the intermediate object 406 is viewed from different angles 404, or when the apparatus 400 is rotated relative to various planes while being viewed from a single point of view.

It will be appreciated that a given embodiment of the apparatus 400 may be configured such that the point of view may be coplanar with one or more planes 414, and may be non-coplanar with the one or more of the various planes 414. That is, a given embodiment of the apparatus 400 may be optimized for being viewed from a point of view that is off-center and at a combination of angles of view relative to a center of the translucent body 402.

The particular example subject shape shown in FIGS. 4A-C and 5A-B is a mouth 412, 512. The first state 412 of the subject shape may include the mouth being in one of an open and closed positions. The second state of the subject shape may include the mouth being in the other one of the open and closed positions. As shown, the mouth is in a closed position in the first state 412 and is in an open position in the second state 512. In other examples, the subject shape may include any other suitable shape. Suitable subject shapes may include organic and non-organic objects. Examples of subject shapes may include: an eye, an eyebrow, a heart, a door, a distinctive mark, and a graphic design.

In another aspect, the intermediate body 202, 406 in the various implementations of the apparatus 100, 300, 400 may include at least one of: an opaque, a translucent, a transparent, and a colored material. In some cases, at least one light in the plurality of lights 204, 410 may include a colored light. Such features may be used to create various visual effects with respect to a subject shape 104, 106, 304, 306, 412, 512.

The suitability of a subject shape 104, 106, 304, 306, 412, 512 for a particular implementation may be dictated by, for example, an intended use of the apparatus 100, 300, 400, and the dimensions of object(s) with which it may be desired to implement the apparatus 100, 300, 400. In one example, the apparatus 100, 400 may include a toy, a surface of the toy may include the translucent body 402, and the subject shape may represent a part of the toy. Accordingly, the particular features of that apparatus 100, 400 may be dictated by, for example, the dimensions of the toy 108, and the toy's 108 intended uses. For example, where the toy 108 is a plush toy, the translucent body 402 may be made from a suitably flexible material so as to preserve an ergonomic aspect of the toy 108.

In yet another aspect, for example as shown with respect to the embodiments of the apparatus 100 shown in FIGS. 2 and 4A-C, various implementations of the apparatus 100, 400 may include a three-axis accelerometer 214 (or any other suitable position sensor) in electronic communication 216 with the controller 210 of the apparatus 100, 400. The accelerometer 214 may be operable to detect an orientation of the apparatus 100, 400. The controller 210 may be operable to turn the plurality of lights 204, 410 on and off in response to changes of the orientation of the apparatus 100, 400, so as to, for example, provide for the generation of an illusion of animation of a subject shape in response to the changes of the orientation. Examples of alternative position sensors include, for example, a 3-axis tilt roller ball sensor. For greater certainty, the term 'position sensor' as used herein refers to a sensor that is used in determining the position of the apparatus 100. The position of the apparatus 100 may include the spatial position (e.g. in x, y and z coordinates), and/or the angular position (also referred to as the orientation) of the apparatus 100.

The fixed positions described with respect to the various possible components of the apparatus 100, 400 may be implemented using any suitable structure and any suitable method. In some embodiments, the components may be permanently fixed in the fixed positions. In other embodiments, at least one of the fixed positions may be adjustable. A particular example is described next for illustration. As shown in FIG. 2, the intermediate body 202 may be fixed to the screen 102. In one example, the intermediate body 202 may be fixed to the screen 102 via a rigid rod 206. The intermediate body 202 may in some cases be permanently or attached to the rod 206. In other cases, the body may be removably attached to the rod 206.

Any suitable connector may be used to effect any one of permanent, removable, and adjustable connections. Likewise, the plurality of lights 204, 410 may be disposed in a fixed position relative to, for example, the screen 102 via any suitable structure 224. The suitability and particular features of such a structure may be dictated by the particular embodiment of an apparatus 100, 300, 400, and the object(s) with which the apparatus 100, 300, 400 may be implemented.

For example, where the apparatus 100, 400 is implemented in a toy 108, the structure of the toy may provide for the fixed position of the plurality of lights 204, 410. Where, as for example is shown in FIG. 3, the apparatus 100, 400 is implemented as a billboard 302, the fixed positions of the components of the apparatus 100, 400 may be provided via suitable mounts to a billboard frame 302.

In all implementations, the positioning (for example, dimensions, distances, and angles) of each of the components of the apparatus 100, 300, 400 may be dictated by the particulars of each implementation and objects with which a given apparatus 100, 300, 400 may be implemented. In the examples of toy and billboard 302 implementations, the positioning of the components may be dictated at least by the dimensions of the toy and billboard, respectively, by a desired size and brightness of the subject shape(s), and by a desired positioning of the subject shape(s) relative to the toy and billboard, respectively.

In some cases, dimensions and proportions of objects with which a given embodiment of the apparatus 100, 300, 400 may be implemented may require the use of additional components with the apparatus 100, 300, 400, in order to achieve the functionality described in this document. Such additional components may be selected using any suitable known optic calculation techniques, technology, and components.

Additional components may be implemented to achieve, for example, desired sizes of unique outlines projected onto the screen (or translucent body, as applicable) of a particular embodiment of the apparatus 100, 300, 400. For example, known optics calculation techniques may be used to size and position one or more lenses to enlarge the size of unique outlines 104, 106 projected by one or more lights of a particular embodiment of the apparatus 100, 300, 400.

In yet a further aspect, while the embodiments of the apparatus 100, 300, 400 described above each include a plurality of lights 204, 410, other embodiments of the apparatuses 100, 300, 400 may include a single light (not shown) to achieve the same functionality. For example, a single light may be implemented on a rail such that the single light may be selectively slidable in relation to, for example, the screen 102 and the intermediate body 202, 406. In such embodiments, selective sliding may be achieved by providing a support slidable along the rail, mounting the single light to the support, and providing a motor (such as a servo-motor) coupled to, for example, the support, to drive the support up and down along the rail.

The motor may be electrically coupled to the controller of the apparatus. Other means for providing for the described functionality of the various embodiments of the apparatus 100, 300, 400 using a single light may also be provided. In yet another aspect, in embodiments of the apparatus 100, 400 which include a position sensor, such as the accelerometer 214, the controller 210 may be programmed to operate the motor and thereby slide the single light along the rail to pre-determined positions in response to signals from the accelerometer 214. Such signals may include, for example, information regarding the orientation of the apparatus 100, 400. The pre-determined positions may be set to, for example, display various desired states 104, 106, 304, 306, 412, 512 of a subject shape at various orientations of a particular embodiment of the apparatus 100, 400.

A method of generating an illusion of animation of a subject shape 104, 106, 304, 306, 412, 512 is described next. The method may comprise providing a screen 102, 308, 402, an intermediate body 202, 406, and a plurality of lights 204, 410, positioning the intermediate body 202, 406 and plurality of lights 204, 410 into fixed positions relative to the screen 102, 308, 402 such that the intermediate body 202, 406 is positioned between the screen 102, 308, 402 and the plurality of lights 204, 410 and such that each light in the plurality of lights 204, 410 is operable to project a unique outline 104, 106, 304, 306, 412, 512 of the intermediate body 202, 406 onto the screen 102, 308, 402, and such that each unique outline 104, 106, 304, 306, 412, 512 depicts the subject shape 104, 106, 304, 306, 412, 512 in a unique state of that subject shape 104, 106, 304, 306, 412, 512.

In another aspect, the method may include selecting a shape of the intermediate body 202, 406 and operating the plurality of lights 204, 410 in an order selected to project a succession 112, 308 of unique outlines 104, 106, 304, 306, 412, 512 of the intermediate body 202, 406 onto the screen 102, 308, 402, such that at least two unique outlines 104, 106, 304, 306, 412, 512 in the succession of unique outlines 104, 106, 304, 306, 412, 512 may depict the subject shape 104, 106, 304, 306, 412, 512, such that each of the at least two unique outlines 104, 106, 304, 306, 412, 512 may depict the subject shape 104, 106, 304, 306, 412, 512 in a unique state of that subject shape 104, 106, 304, 306, 412, 512, and such that viewing the at least two unique outlines 104, 106, 304, 306, 412, 512 in the succession may create an illusion of animation of that subject shape 104, 106, 304, 306, 412, 512.

In another aspect, the method may include operating the plurality of lights 204, 410 at time intervals sufficient to create the illusion of animation. Time intervals may be sufficient where, for example, the time intervals are sufficiently short to provide a sufficiently-quick succession of unique outlines 104, 106, 304, 306, 412, 512 to generate the illusion of animation from the point of view of a viewer 404*a* viewing 404 the succession.

In yet another aspect, the method may include providing a position sensor, such as a three-axis accelerometer 214 in electronic communication with a controller 210, the accelerometer 214 being operable to detect an orientation of the screen 102, 308, 402. The controller 210 may be in electronic communication with the plurality of lights 204, 410. The method may further include a step of programming the controller 210 to operate the plurality of lights 204, 410 in response to changes of the orientation of, for example, the screen 102, 308, 402.

In one example, the controller 210 may be programmed to detect, for example, when the screen is tilted 102, 308, 402, and to operate one or more lights in the plurality of lights 204, 410 in response. Responsive operation of the controller 210 may be configured such that a projection 104, 106, 304, 306 depicting the subject shape 104, 106, 304, 306, 412, 512 in a state desired to be displayed in one or more orientations (such as tilts) of the screen 102, 308, 402 is projected by the one or more lights in the plurality of lights 204, 410 onto the screen 102, 308, 402 in each corresponding orientation.

The apparatuses and methods described above may be implemented using any suitable and known materials, components, and manufacturing and assembly techniques. While particular examples of apparatuses and methods are described above, it will be appreciated that other apparatuses and methods may be within the scope of the claims included in this document.

The invention claimed is:

1. A method of generating an illusion of animation of a subject shape, comprising:

providing a screen;

providing an intermediate body and a plurality of lights;

positioning said intermediate body and plurality of lights into fixed positions relative to said screen such that the intermediate body is positioned between the screen and the plurality of lights and such that each light in the plurality of lights is operable to project a unique outline of said intermediate body onto said screen, said unique outline depicting the subject shape in a unique position of that subject shape;

illuminating a first one or more of the plurality of lights to generate a first projection of the intermediate body, showing a first outline on the screen which is the subject shape in a first position; and illuminating a second one or more of the plurality of lights to generate a second projection of the intermediate body, showing a second outline on the screen which differs from the first outline, which is the subject shape in a second position, thereby generating an illusion of animation of the subject shape.

2. The method of claim 1, wherein the screen is translucent.

3. The method of claim 2, wherein the screen has a viewing side and a lights-side, the viewing side being opposite the lights-side and the lights-side facing the lights; and the screen has a translucency selected such that each unique outline of the plurality of unique outlines projected onto the screen is visible to a user of the apparatus viewing the screen from said viewing side.

4. The method of claim 1, wherein the screen has a translucency selected such that the intermediate body is substantially invisible through the screen.

5. The method of claim 1, wherein the intermediate body includes a plurality of non-coplanar outline surfaces oriented relative to each of the screen and the plurality of lights such that at least a portion of light emitted by each light in the plurality of lights, when that light is turned on, is obstructed by at least one of said surfaces and is thereby prevented from shining directly onto the screen.

6. The method of claim 1, wherein the intermediate body includes at least one of: an opaque, a translucent, a transparent, and a colored material.

7. The method of claim 1, wherein at least one light in the plurality of lights includes is a colored light.

8. The method of claim 1, wherein:

the method includes providing a position sensor in electronic communication with a controller, said position sensor being operable to detect an orientation of said screen, said controller being in electronic communication with the plurality of lights; and programming said controller to be operable to operate the plurality of lights in response to changes of said orientation so as to project each unique outline in the plurality of unique outlines at a pre-determined orientation of the screen for that unique outline.

9. An apparatus for creating an illusion of animation of a subject shape, comprising:

a screen;

an intermediate body;

a plurality of lights; and a controller in electronic communication with said plurality of lights, said controller being operable to turn the plurality of lights on and off in at least one of: a selected order, a combination, and a simultaneous operation of all of the lights;

said intermediate body and plurality of lights being fixed relative to said screen such that:

a) said intermediate body is positioned between the screen and the plurality of lights, b) when at least one first light in the plurality of lights is operated, the at least one first light projects a first projection of the intermediate body, showing a first outline on the screen which is the subject shape in a first position, and c) when at least one second light in the plurality of lights is operated, the at least one second light projects a second projection of the intermediate body, showing a second outline on the screen which differs from the first outline, and which is the subject shape in a second position.

10. The apparatus of claim 9, wherein the screen includes at least one material selected from a group of translucent and transparent materials.

11. The apparatus of claim 9, wherein the screen has a viewing side and a lights side, the viewing side is opposite the lights side and the lights side faces the plurality of lights; and the screen has a translucency selected such that each outline of the intermediate body projected onto the screen is visible to a user of the apparatus viewing the screen from said viewing side.

12. The apparatus of claim 11, wherein the translucency of the screen is selected such that the intermediate body is substantially invisible to said user viewing the screen from said viewing side.

13. The apparatus of claim 9, wherein the subject shape includes at least one of: a mouth, an eye, an eyebrow, and a heart of said toy.

14. The apparatus of claim 13, wherein the screen is disposed in place of at least one feature of the toy.

15. An apparatus for creating an illusion of animation of a subject shape, comprising:

a translucent body having a viewing side and a lights side opposite the viewing side;

an intermediate body;

a plurality of lights disposed on the lights side of said translucent body, said intermediate body being positioned between said translucent body and said plurality of lights such that when at least one light in the plurality of lights is turned on, a silhouette of the intermediate body is visible through the translucent body from the viewing side of the translucent body; and a controller in electronic communication with the plurality of lights, wherein the controller is programmed to:

illuminate a first one or more of the plurality of lights to generate a first projection of the intermediate body, showing a first silhouette on the screen which is a subject shape in a first position, and illuminate a second one or more of the plurality of lights to generate a second projection of the intermediate body, showing a second silhouette on the screen which differs from the first silhouette, which is the subject shape in a second position, thereby generating an illusion of animation of the subject shape.

16. The apparatus of claim 15, wherein the intermediate body and the plurality of lights are positioned fixedly relative to said translucent body.

17. The apparatus claim 15, wherein the apparatus is implemented with a toy, a surface of the toy includes the translucent body, and the subject shape represents a part of the toy to be represented as being animated.

18. The apparatus of claim 15, wherein the apparatus includes a position sensor in electronic communication with the controller, wherein said position sensor is operable to detect an orientation of the apparatus, and said controller is operable to turn said lights on and off in response to changes of said orientation.

* * * * *